US008861763B2

(12) United States Patent
Yukawa

(10) Patent No.: US 8,861,763 B2
(45) Date of Patent: Oct. 14, 2014

(54) SPEAKER RETAINING MECHANISM AND TELEVISION RECEIVER COMPRISING SAME

(75) Inventor: Masahiro Yukawa, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/468,672

(22) Filed: May 10, 2012

(65) Prior Publication Data

US 2012/0219173 A1 Aug. 30, 2012

Related U.S. Application Data

(63) Continuation-in-part of application No. PCT/JP2010/007209, filed on Dec. 13, 2010.

(30) Foreign Application Priority Data

Dec. 14, 2009 (JP) ..... 2009-282499

(51) Int. Cl.
*H04R 1/02* (2006.01)
*H04R 1/28* (2006.01)

(52) U.S. Cl.
CPC ..... *H04R 1/025* (2013.01); *H04R 1/2896* (2013.01)
USPC ..... 381/333; 381/388; 381/392; 381/386; 381/395

(58) Field of Classification Search
CPC .... H04R 1/025; H04R 5/02; H04R 2205/021; H04R 1/2888; H04R 9/066; H04R 1/2896; H04R 1/2892; H04R 1/2807; H04R 1/028; H04R 1/28; H04R 2499/15; H04R 1/00; H04R 1/02; H04R 1/021; H04R 1/026; H04R 1/2803; H04R 1/2869; H04R 1/2811; H04R 1/2873; H04R 1/2876; H04R 1/288; H04R 2201/02; H04R 2201/021; H04R 2201/025; H04N 5/64; H04N 5/642; B60R 11/0217; B60R 2011/0045; B60R 2011/0019; B06R 2011/0059
USPC ..... 381/87, 386, 392, 150, 152, 336, 374, 381/332–334, 365, 388–389
See application file for complete search history.

(56) References Cited

U.S. PATENT DOCUMENTS 6,489,402 B2 12/2002 Ohyama et al.
6,760,460 B1 * 7/2004 Jeon ..... 381/388
(Continued)

FOREIGN PATENT DOCUMENTS

JP 57-36081 2/1982
JP 2000-103920 4/2000
(Continued)

OTHER PUBLICATIONS

International Search Report issued in International Patent Application No. PCT/JP2010/007209, mailed Jan. 25, 2011.

*Primary Examiner* — Ahmad Matar
*Assistant Examiner* — Sabrina Diaz
(74) *Attorney, Agent, or Firm* — McDermott Will & Emery LLP

(57) ABSTRACT

A speaker retaining mechanism for retaining a speaker at a predetermined position of a cabinet is disclosed. This speaker retaining mechanism includes: a retaining member that is fixed to the cabinet and that has a hollow space surrounded by an inner wall; and a vibration damping member attached to both ends of the speaker. The vibration damping member is disposed in the hollow space of the retaining member so that the vibration damping member contacts elastically with the inner wall of the retaining member.

13 Claims, 7 Drawing Sheets

(56) References Cited

U.S. PATENT DOCUMENTS

| | | | | |
|---|---|---|---|---|
| 7,162,048 | B2 * | 1/2007 | Shima | 381/334 |
| 7,894,182 | B2 * | 2/2011 | Wang et al. | 361/679.23 |
| 8,073,182 | B2 * | 12/2011 | Li et al. | 381/386 |
| 2002/0019478 | A1 | 2/2002 | Ohyama et al. | |
| 2009/0242322 | A1 * | 10/2009 | Tsai | 181/207 |

FOREIGN PATENT DOCUMENTS

| | | | | |
|---|---|---|---|---|
| JP | 2000-138988 | * | 5/2000 | H04R 1/02 |
| JP | 2006-217273 | | 8/2006 | |
| JP | 2007-201990 | | 8/2007 | |

* cited by examiner

SPEAKER RETAINING MECHANISM AND TELEVISION RECEIVER COMPRISING SAME

RELATED APPLICATIONS

This application is a continuation in part application of Patent Cooperation Treaty Patent Application No. PCT/JP2010/007209 (filed on Dec. 13, 2010), which claims priority from Japanese patent application JP 2009-282499 (filed on Dec. 14, 2009).

TECHNICAL FIELD

The present invention relates to a speaker retaining mechanism that suppresses a vibration of a speaker from being transmitted to a cabinet and that can provide a higher sound quality by stable attachment and retention of the speaker, and a television receiver including this speaker retaining mechanism.

BACKGROUND ART

It is very important to prevent the vibration of a speaker system in a television receiver. Regarding a Cathode Ray Tube (CRT)-type television receiver, a problem has been reported in which the speaker vibration causes the vibration of a shadow mask in the CRT via a cabinet to consequently cause an image having a color shift, for example. Regarding a flat panel television receiver, for example, the liquid crystal or the plasma, the transmission of the vibration from the speaker easily causes the resonance sound of the cabinet or the resonance sound of the printed board. This gives a more strict specification regarding to small space and small clearance design, resulting in an obstacle against a design having a thinner thickness. Furthermore, the resonance sound by the vibration is also an obstacle for developing a television receiver having a higher sound quality. Therefore, it is important to establish an effective vibration damping mechanism in order to provide a speaker system having a wider bandwidth and a higher volume output.

Generally, a speaker retaining mechanism of a television receiver is structured so that a speaker is attached and fixed via a vibration damping member. For example, Japanese Patent Unexamined Publication No. 2000-138988 (Publication 1) discloses a technique to attach a vibration damping member to a retaining member of a speaker to thereby prevent vibration from being transmitted to a cabinet. Publication 1 discloses a technique in which to fix a vibration damping member to a speaker and to insert the vibration damping member to a boss of a cabinet or the like to fix the cabinet by a screw.

Japanese Patent Unexamined Publication No. 2000-103920 (Publication 2) discloses a technology to reduce the hardness of the vibration damping member and thereby improve the vibration damping effect.

However, when considering the vibration damping member disclosed in Publication 1 to be substituted with the vibration damping member having a reduced hardness disclosed in Publication 2, the stability of the speaker retention reduces as the hardness of the vibration damping member reduces, and this limits the reduction of the hardness. Specifically, regarding the configuration as disclosed in Publication 1, the hardness of the vibration damping member is limited to about 20 degrees, and when the hardness is 10 degrees or less, it cannot provide a stable retention of the speaker. Further, when a vibration damping member having a hardness of 10 degrees or less is used, it is even difficult to insert the vibration damping member to a boss. Therefore, the combination of techniques disclosed in Publications 1 and 2 is insufficient to provide a sufficient vibration damping effect.

The hardness such as 20 degrees or 10 degrees herein is represented by the rubber hardness based on JIS-K6253 (which is a standard defined by Japanese Industrial Standards (JIS) regarding the hardness test method for vulcanized rubber and thermoplastic rubber).

A vibration damping member having a low hardness also may cause an unstable speaker retention, due to a significant deformation of the vibration damping member itself, caused by the weight of the speaker. This gives a variation in the speaker position Thus, it is difficult to form a baffle face on the front face of the speaker completely, thus failing to provide reproduction having a stable sound quality.

Furthermore, recently, television receivers having structure in which the speaker is attached downwardly and a baffle is formed with a back cover are increasing. In such case, it is desired that the speaker is stably fixed after the assembling of the back cover.

SUMMARY OF THE INVENTION

The present invention relates to a speaker retaining mechanism to retain a speaker at a predetermined position of a cabinet. The speaker retaining mechanism according to an embodiment includes: a retaining member that is fixed to the cabinet and that has a hollow space surrounded by an inner wall; and a vibration damping member attached to both ends of the speaker. The vibration damping member is arranged in the hollow space of the retaining member so that the vibration damping member contacts elastically with an inner wall of the retaining member.

A television receiver of the present invention includes: a cabinet; a speaker; and the above-described speaker retaining mechanism.

DESCRIPTION OF EMBODIMENTS

The embodiment for carrying out the present invention will be described with reference to the drawings.

(First Embodiment)

First Embodiment is an example in which a speaker retaining mechanism of the present invention is applied in a television receiver.

Figure 1:
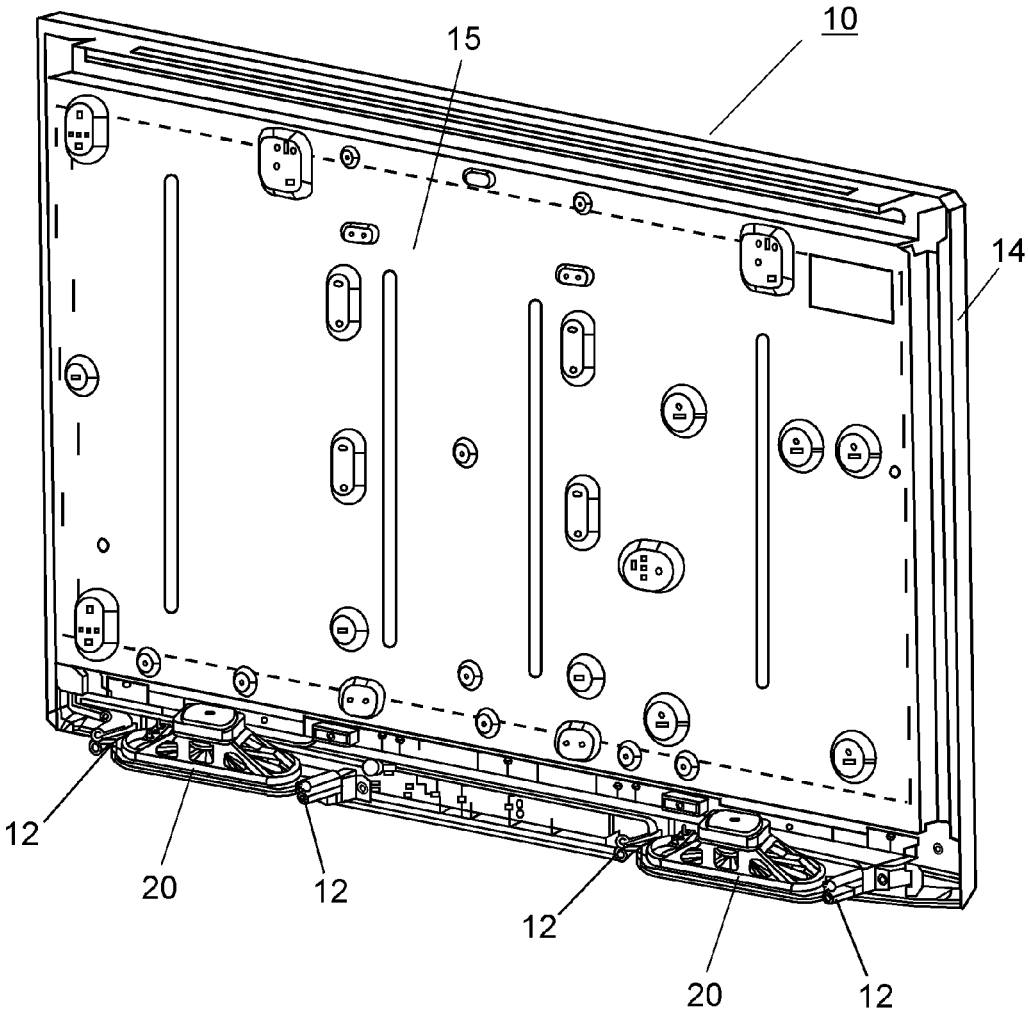
FIG. 1 illustrates the entirety of television receiver 10 including speaker retaining mechanism 12.

FIG. 1 illustrates an entire view of television receiver 10 having speaker retaining mechanism 12.

Television receiver 10 is a thin-screen television receiver having a flat panel (e.g., LCD panel). FIG. 1 is a back perspective view of the television receiver 10 when its back cover is removed.

In television receiver 10, various members are provided in the interior between cabinet 14 and the above-mentioned back cover for sealing the back face of cabinet 14. Cabinet 14 is attached with liquid crystal (LCD) panel 15 for displaying an image. Speaker unit 20 for outputting audio is arranged at the rear face side of cabinet 14 and in the lower part of cabinet 14. Two speaker units 20 function as left and right audio outputs. Each of units 20 is respectively arranged so as to output audio toward the lower side of cabinet 14.

Speaker units 20 are attached to cabinet 14 via speaker retaining mechanism 12.

Figure 2:
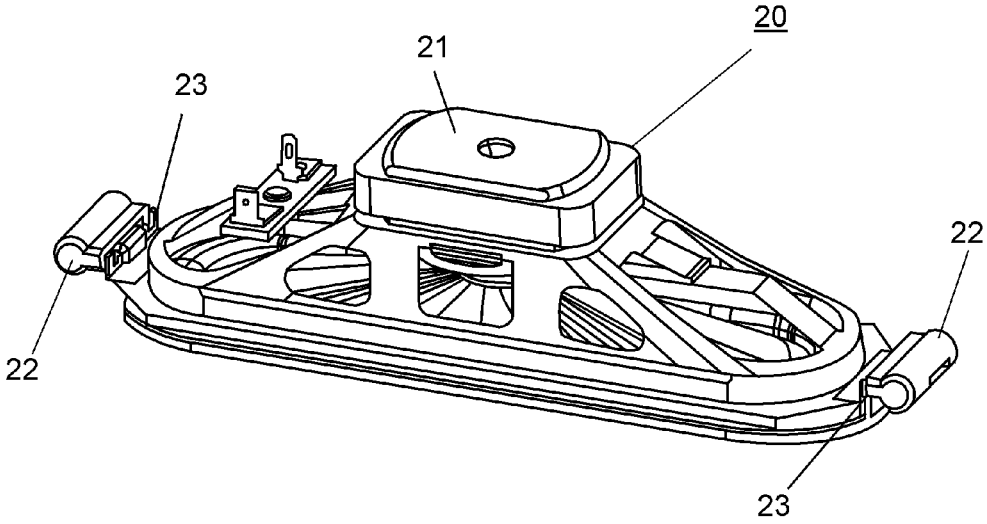
FIG. 2 is a perspective view illustrating the entirety of speaker unit 20 in television receiver 10.
Figure 3:
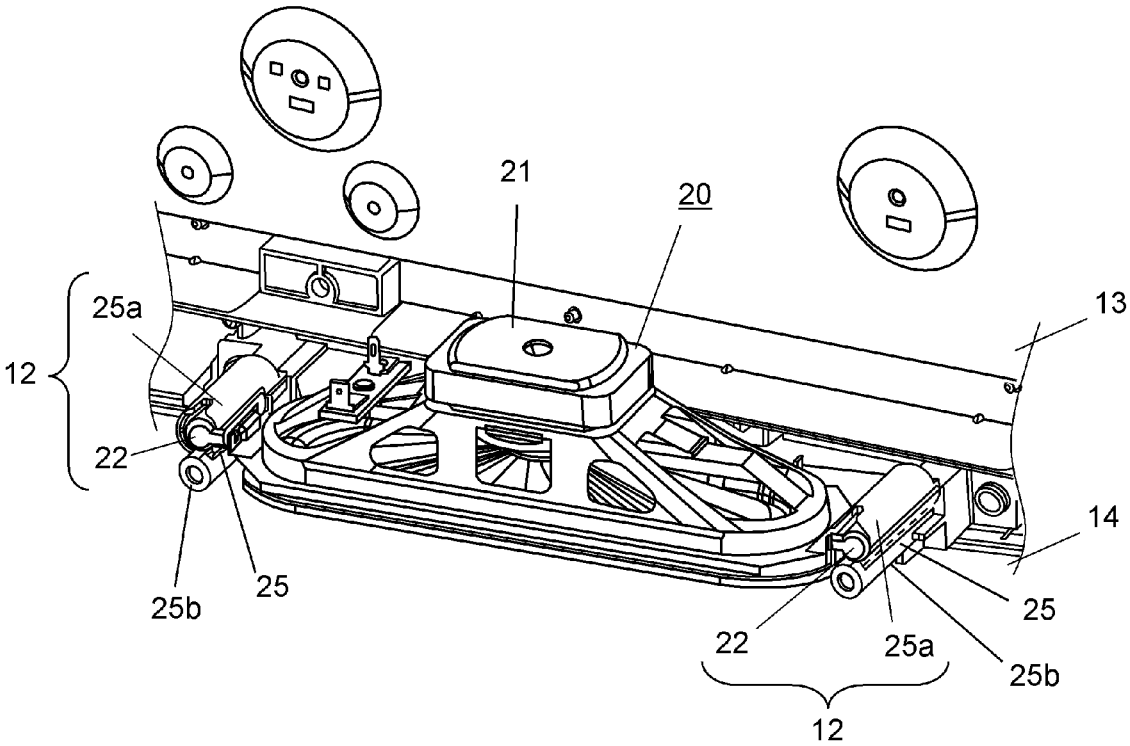
FIG. 3 is an expanded perspective view illustrating speaker unit 20 attached to cabinet 14 via speaker retaining mechanism 12.

FIG. 2 is a perspective view illustrating speaker unit 20 arranged in television receiver 10. FIG. 3 is an expanded perspective view illustrating speaker unit 20 in television receiver 10 of FIG. 1, when speaker unit 20 is attached to cabinet 14 via speaker retaining mechanism 12. As shown in FIG. 2, speaker unit 20 has speaker 21 which outputs audio and vibration damping member 22 having a cylindrical section. Vibration damping member 22 is fixed at both ends of speaker 21 via vibration damping member attachment section 23. In order to cope with a television receiver having a thinner thickness, speaker 21 has a shape elongated in one direction (a substantially-elliptical shape or a substantially-rectangular shape). Vibration damping members 22 are attached to both ends of speaker 21 in the elongated direction.

With reference to FIG. 3, in order to fix speaker unit 20 to cabinet 14, cabinet 14 is provided with speaker bracket 25 having tubular section 25*a* including a hollow space. In each of speaker brackets 25, there is back cover attachment section 25*b* for attaching the back cover by a screw or the like, at the lower side of tubular section 25*a*. Speaker brackets 25 are fixed to cabinet 14 via a screw or are integrated with cabinet 14. Cabinet 14 has, in the lower side thereof, speaker brackets 25 provided at four positions. Specifically, each of the brackets 25 is provided respectively at the left and right sides of each of two speaker units 20. Speaker unit 20 is attached by inserting each vibration damping member 22 of speaker unit 20 into tubular section 25*a* of each speaker bracket 25.

In other words, speaker retaining mechanism 12 is formed comprising vibration damping members 22 attached to vibration damping member attachment sections 23 and tubular sections 25*a* of speaker brackets 25. Here, tubular section 25*a* of speaker bracket 25 functions as a retaining member to retain speaker 21.

Vibration damping member 22 is formed of a very-soft material having elasticity not exceeding the hardness of 10 degrees. That is, vibration damping member 22 is formed by soft and elastic material such as elastomer. As described above, the unit of the hardness is represented as rubber hardness based on JIS-K6253 (which is a standard defined by Japanese Industrial Standards regarding the hardness test method for vulcanized rubber and thermoplastic rubber). Practically, the lower limit of the hardness is 2 degrees (very low hardness) and preferably between 2 to 10 degrees.

By using vibration damping member 22 as described above, speaker 21 can be retained stably in television receiver 10 and vibration from speaker 21 can be suppressed from being transmitted to cabinet 14.

Figure 4:
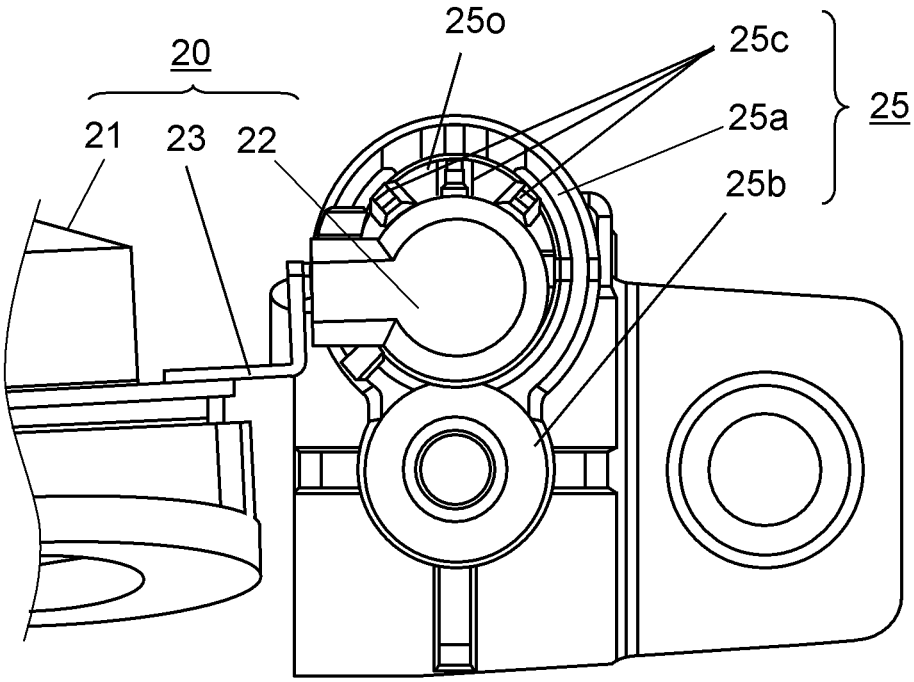
FIG. 4 is an expanded side view illustrating speaker unit 20 attached to speaker bracket 25 via vibration damping member 22.

FIG. 4 is an expanded view illustrating speaker bracket 25 in FIG. 3. Tubular section 25*a* has opening section 25*o* as an insertion hole for inserting vibration damping member 22. Tubular section 25*a* has, at the upper part of the inner wall thereof, a plurality of ribs 25*c*, as a plurality of protrusions, which protrudes to the inner side from the inner wall. By inserting vibration damping member 22 having a low hardness inside the tube of above-described tubular section 25*a* from the back face side of television receiver 10, speaker unit 20 is attached to speaker bracket 25. Although, vibration damping member 22 is soft and is easily deformed, since it contacts with the inner wall of tubular section 25*a* by elastic compression, specifically, the periphery of vibration damping member 22 is surrounded by tubular section 25*a*, the member 22 is suppressed from being deformed.

Figure 5A:
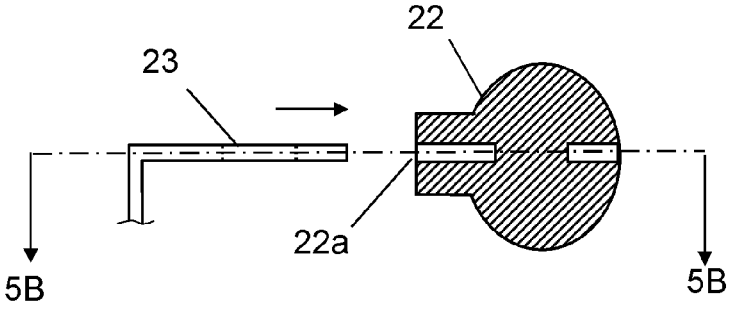
FIG. 5A is a side view illustrating vibration damping member 22 prior to being attached to vibration damping member attachment section 23.
Figure 5B:
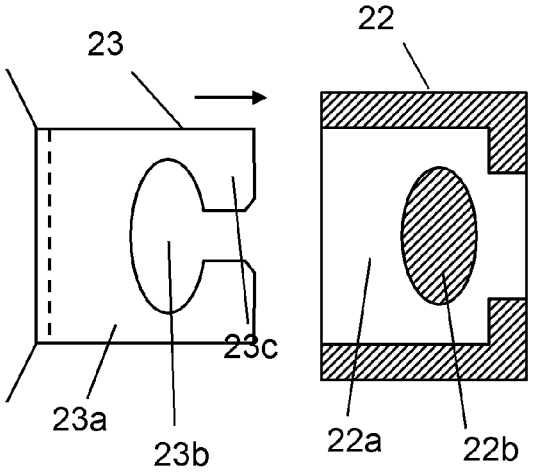
FIG. 5B is a cross-sectional view taken along 5B-5B showing vibration damping member 22 prior to being attached to vibration damping member attachment section 23.

FIG. 5A and FIG. 5B illustrate the configurations of vibration damping member 22 and vibration damping member attachment section 23. FIG. 5A is a side view illustrating vibration damping member 22 prior to being attached to the section 23. FIG. 5B is a cross-sectional view taken along 5B-5B in FIG. 5A. As shown in FIG. 5B, in the end part of the section 23 (i.e., a jointing section with the member 22) has plate section 23*a*, hole section 23*b* provided such that a portion of the section 23*a* is cut off, and opening section 23*c*. On the other hand, as shown in FIG. 5A, vibration damping member 22 has space 22*a* for inserting the section 23*a* is provided near the center of the side face side. As shown in FIG. 5B, the member 22 also has convex section 22*b* near the center of the space 22*a*, when seen from the upper face of the space 22*a*. By inserting vibration damping member attachment section 23 to space 22*a* of the above-described vibration damping member 22, the member 22 is attached to the section 23. Since vibration damping member 22 is made by soft material, when inserting, convex section 22*b* can be easily inserted into hole section 23*b* through opening section 23*c*. When inserted, since convex section 22*b* is engaged with hole section 23*b*, the member 22 is attached to the section 23 with a sufficient retaining force.

Figure 5C:
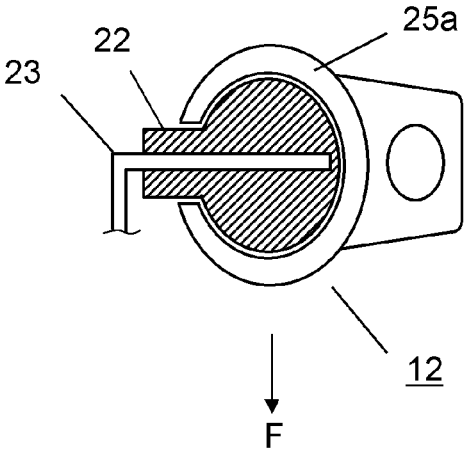
FIG. 5C is a side view illustrating the vibration damping member attached to tubular section 25*a*.

FIG. 5C is a side view illustrating vibration damping member 22 attached to tubular section 25*a* in television receiver 10. The member 22 is fixed contacted elastically to the inner wall of tubular section 25*a* of speaker bracket 25. Specifically, the member 22 is retained at the inner wall of tubular section 25*a*, as the retaining member, only by the elastic compression. Vibration damping member attachment section 23 is arranged in tubular section 25*a* filled with soft vibration damping member 22, and on the member 22. In other words, the section 23 is provided such that it is floated in the member 22 receiving gravity force toward the ground (the direction F in FIG. 5C) due to weight of speaker unit 20.

Thus, vibration damping member 22 absorbs the vibration transmitted to vibration damping member attachment section 23 from speaker 21. Thereby the vibration caused by speaker 21 from is suppressed from being transmitted to cabinet 14.

In contrast to the example of FIG. 5C, in which the vibration damping member 22 contacts entirely with the inner wall of tubular section 25*a*, by providing ribs 25*c* in the inner wall of tubular section 25*a* as shown in FIG. 4, it allows an easy insertion of member 22 to tubular section 25*a* along ribs 25*c* because of the spaces made between ribs 25*c*. On the other hand, as for the lower part of tubular section 25*a*, which does not have ribs 25*c*, since vibration damping member 22 contacts the inner wall of tubular section 25*a* elastically compressed, the similar vibration damping effect as that by the configuration shown in FIG. 5C is provided.

In the back face of television receiver 10, the back cover for covering cabinet 14 is attached, and thus opening section 25*o* of tubular section 25*a* is sealed. Specifically, the opening section 25*o*, which is an insertion hole for inserting vibration damping member 22 is formed in the back cover side. In a position of the back cover corresponding to opening section 25*o*, a cap for sealing opening section 25*o* is provided, and thus, vibration damping member 22 is substantially sealed by tubular section 25*a* and the cap when the back cover is attached. As a result, the entire periphery of vibration damping member 22 is sealed by elastic compression. Thereby, soft vibration damping member 22 can be suppressed from being protruded from the opening part (opening section 25*o*) due to a pressurization force, and thus, a retaining force and a vibration damping effect can be improved. This configuration, in which vibration damping member 22 is substantially sealed, allows the usage of material having a low hardness as a vibration damping member 22, and by usage of low hardness material the vibration damping effect is improved.

Figure 6:
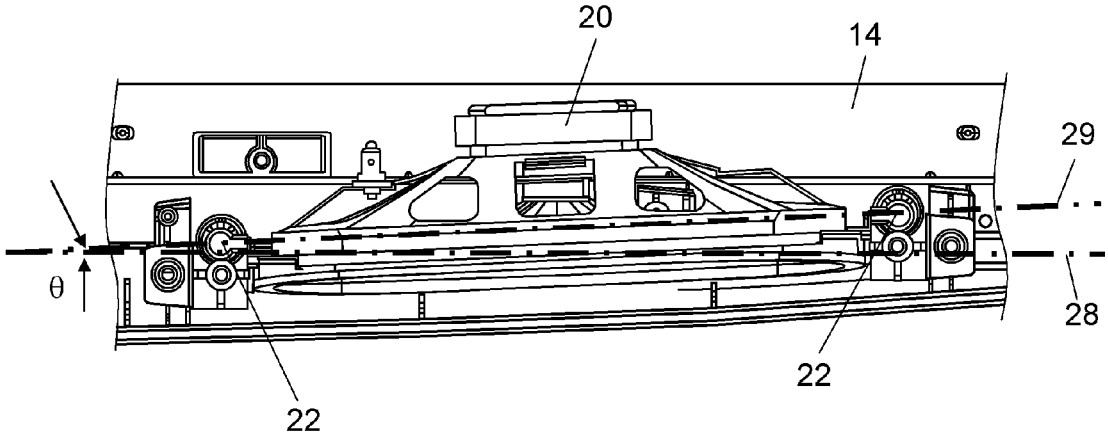
FIG. 6 illustrates an example in which speaker unit 20 is fixed obliquely.

Furthermore, since vibration damping member 22 has a cylindrical section, when attaching vibration damping member 22 to tubular section 25*a* of speaker bracket 25, by rotating the member 22 in the circumferential direction of the tubular section 25*a* the member 22 can be inserted. As a result, when speaker unit 20 is desired to be fixed in an oblique direction as shown in FIG. 6 for example, the speaker attaching angle is adjusted easily. Specifically, by rotating speaker unit 20 centering one of the two tubular sections 25*a*, the position of the other section 25*a* can be determined, and thus it is easy to design the attachment of the speaker unit 20. Since design (angle) of lower side face of the back cover varies depending on manufacturing models, it is necessary to change the angle so that speaker unit 20 is attached suitably to cabinet 14 for each of the manufacturing models. However, according to this structure, it is easy to design an attachment of the speaker. FIG. 6 illustrates a case where speaker unit 20 is fixed slanted with angle θ which is an angle between a broken line 28 (a horizontal line) and broken line 29.

Generally, speaker unit 20 has many metal components and thus the unit 20 has a considerable weight. Because of this, it may not be able to provide sufficient retention force only by above-described speaker retaining mechanism. Therefore, by employing second vibration damping member 32 in the lower part of speaker unit 20, and by supporting the speaker unit 20 subsidiarily by this member 32, it can reinforce the retention of speaker unit 20.

Figure 7:
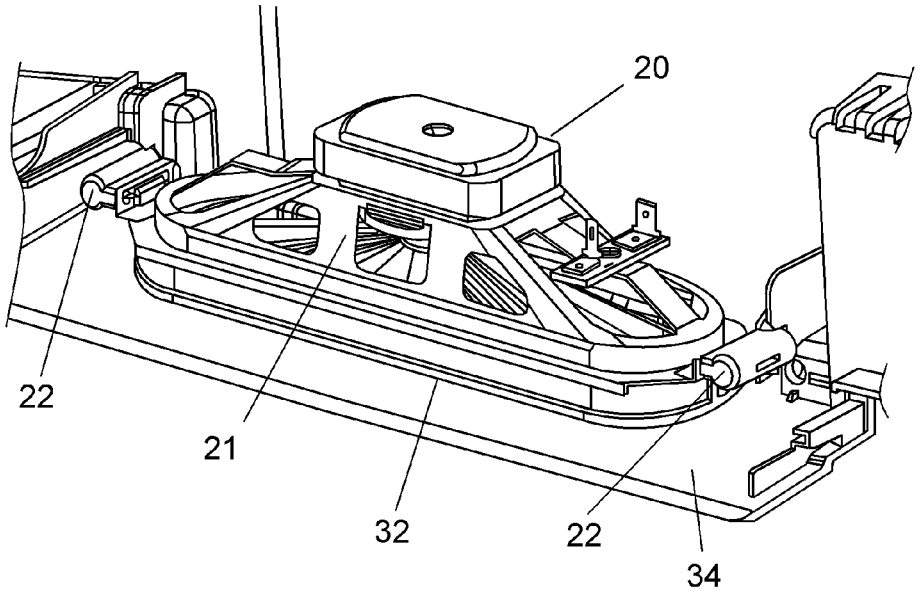
FIG. 7 is a partial perspective view illustrating a configuration example using vibration damping member 32.
Figure 8:
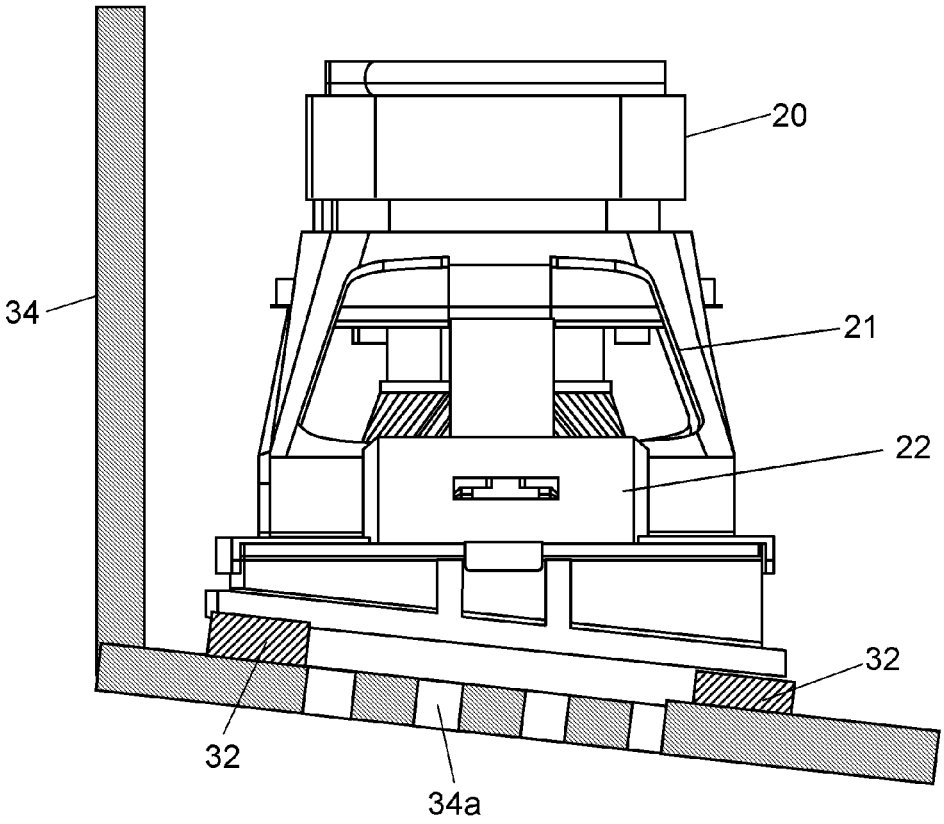
FIG. 8 is a cross-sectional view illustrating a configuration example using vibration damping member 32.

FIG. 7 is a perspective view illustrating speaker unit 20 portion of television receiver 10 when vibration damping member 32 is applied. FIG. 8 is a cross-sectional view of the speaker unit 20 portion. For simplicity, in the FIG. 7 and FIG. 8, illustration of cabinet 14 is omitted and the arrangement of speaker unit 20 to back cover 34 is shown.

As shown in FIG. 7, between the lower part of speaker unit 20 and back cover 34, vibration damping member 32 is arranged. As shown in FIG. 8, conforming the position of speaker 21, back cover 34 has sound hole 34*a* through which sound is emitted to the outside.

Vibration damping member 32 is composed of soft material such as foamed sponge (e.g., urethane foam). As a result, both ends of speaker unit 20 are retained by speaker retaining mechanism 12 and are also subsidiarily retained by vibration damping member 32 arranged between speaker unit 20 and back cover 34. Further, since speaker unit 20 is arranged on vibration damping member 32 while contacting elastically with back cover 34, the vibration caused in speaker 21 can be suppressed from being transmitted to back cover 34.

Furthermore, vibration damping member 32 can be used to easily and securely form, between speaker unit 20 and back cover 34, a baffle that suppresses interference of between sound emitted from the front face and from the rear face of speaker 21.

Specifically, by adhering vibration damping member 32 to the periphery of sound hole 34*a*, it can be prevented from having a gap between speaker unit 20 and back cover 34 in the periphery of sound hole 34*a*. As a result, the baffle face can be completely formed at the back face of speaker unit 20. Thus, by providing vibration damping member 32 as described above, sound can be efficiently outputted from sound hole 34*a*.

(Second Embodiment)

Figure 9:
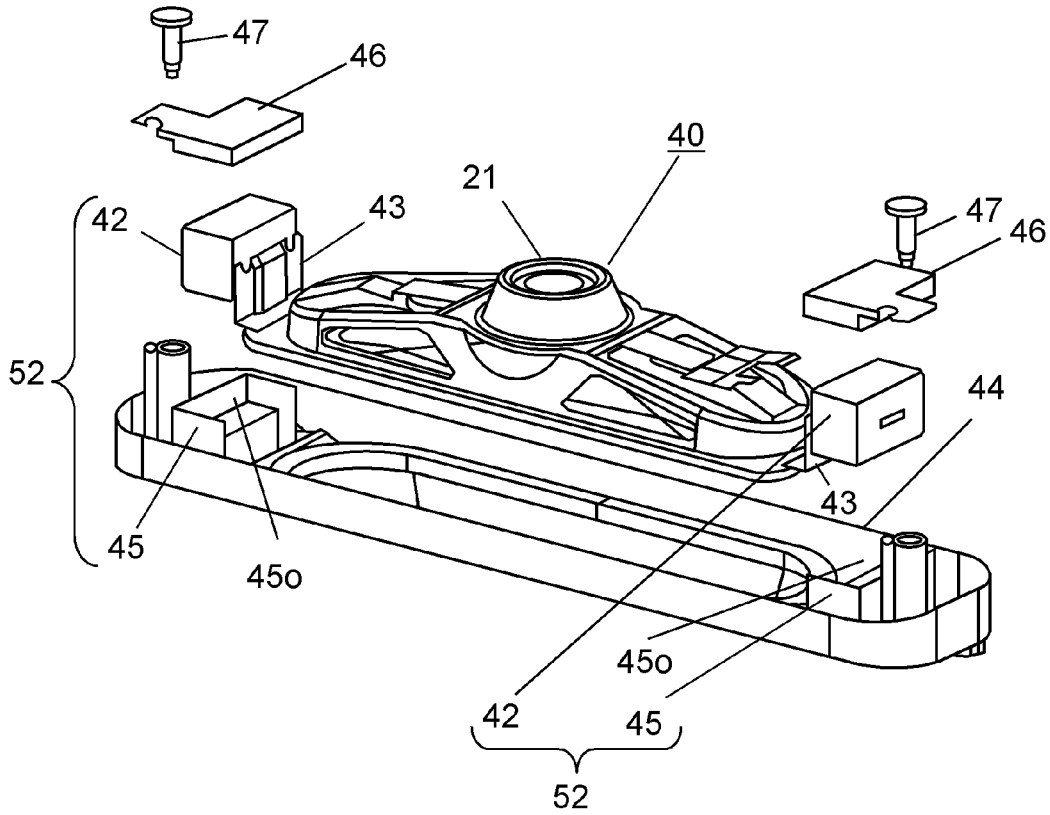
FIG. 9 is an exploded perspective view illustrating speaker unit 40 and the retaining mechanism thereof.
Figure 10:
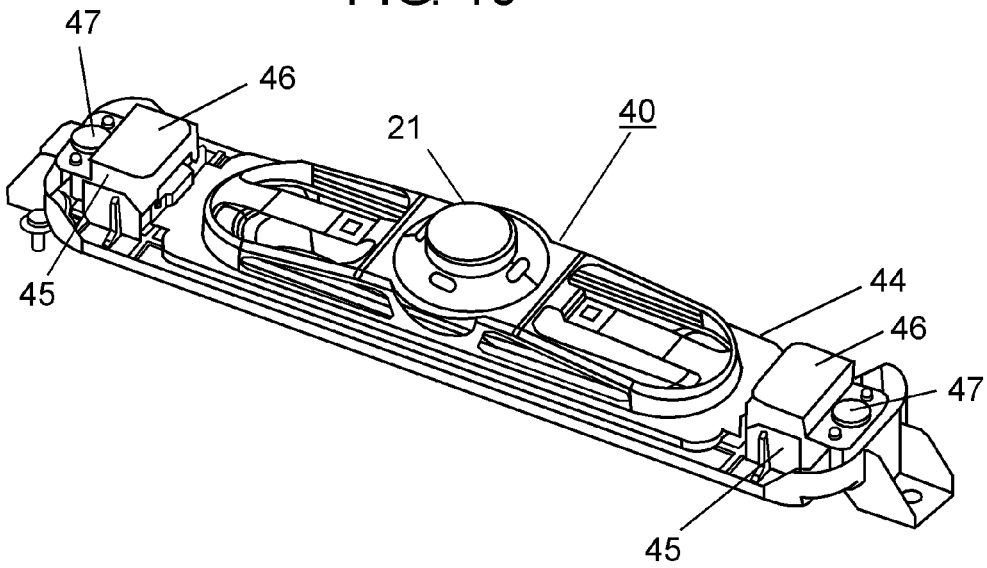
FIG. 10 is a perspective view illustrating speaker unit 40 and the speaker retaining mechanism thereof

FIG. 9 is an exploded perspective view illustrating the configuration of speaker unit 40 and speaker retaining mechanism 52 for retaining speaker unit 40 in second embodiment of the present invention. FIG. 10 is a perspective view illustrating speaker unit 40 shown in FIG. 9 when viewed from its top.

Speaker retaining mechanism 52 includes: vibration damping members 42 having a rectangular parallelepiped-like shape (or a cube-like shape) attached to both ends of speaker 21; and speaker bracket 45, as the retaining member, having a hollow space conforming to the shape of vibration damping member 42.

Speaker unit 40 includes speaker 21 for outputting sound and vibration damping member 42 as described above. Vibration damping members 42 are fixed to both ends of speaker 21 via vibration damping member attachment sections 43. As in the first embodiment, vibration damping member 42 is formed by very soft elastic material having hardness not exceeding 10 degrees for example.

As shown in FIG. 9, in order to fix speaker unit 40 to cabinet 44, cabinet 44 has speaker brackets 45 having hollow shape so as to conform with vibration damping member 42. Speaker unit 40 is attached by inserting vibration damping members 42 provided at both ends of speaker unit 40 to the respective hollow spaces of two left and right speaker brackets 45. Specifically, speaker brackets 45, as the retaining member includes opening 45*o* having an insertion hole into which the vibration damping member is inserted. In the upper part of speaker bracket 45, to which vibration damping member 42 is inserted, cap 46 functioning as a sealing section for sealing opening 45*o* is arranged, and cap 46 is fixed by screw 47.

Thereby, as shown in FIG. 10, speaker retaining mechanism 52 in which vibration damping member 42 is inserted to the hollow space of speaker bracket 45 and is sealed by cap 46 is formed. As well as the first embodiment, the speaker retaining mechanism in the present embodiment is also structured so that the periphery of the vibration damping member is surrounded by the inner wall of the speaker bracket or the like, and thus deformation of the soft and easily-deformable vibration damping member 42 is suppressed by the contacting elastically to the inner wall of speaker bracket 45 and cap 46.

In the present embodiment, since vibration damping member attachment section 43 is also arranged inside the vibration damping member 42 which is soft and elastic. Thus, vibration caused in speaker 21 transmitted to the section 43 is absorbed by vibration damping member 42. This can consequently suppress the vibration caused in speaker 21 from being transmitted to cabinet 44. Furthermore, since speaker unit 40 is retained by speaker bracket 45 via vibration damping member 42, speaker unit 40 can be retained while securing sufficient stability.

In the present embodiment, since vibration damping member 42 has a structure having a rectangular parallelepiped-like shape or a cube-like shape, speaker unit 40 can be arranged facing downward direction, as well as in the first embodiment, or front face direction of television receiver 10.

As well as the first embodiment, a baffle may be formed by providing a second vibration damping member between speaker unit 40 and cabinet 44.

According to speaker retaining mechanism of the above embodiments, it is able to utilize a vibration damping member having a reduced hardness while securing the retaining force of the speaker. By use of the reduced hardness vibration damping member, it can improve the vibration damping effect as well as stably retaining the speaker, and can provide high sound quality.

In the first and second embodiments, it is described that the first vibration damping member is formed by elastomer material and the second vibration damping member is formed by urethane foam material. Alternatively, the first and second vibration damping members may be formed by elastic material such as rubber.

In the above, it is described that the vibration damping member has a columnar shape, a rectangular parallelepiped shape, or a cube shape, however, its shape is not limited to them and but also the other shapes.

In the above description, the speaker retaining mechanism of the present invention is exemplarily described by an example utilized in a television receiver, however the present invention may be applied in other devices having a speaker.

The invention claimed is:

1. A speaker retaining mechanism for retaining a speaker at a predetermined position of a cabinet, comprising:

a retaining member that is fixed to the cabinet and that has a hollow tubular space surrounded by an inner wall, and a vibration damping member attached to both ends of the speaker, wherein the vibration damping member is arranged in the hollow tubular space of the retaining member so that the vibration damping member contacts elastically with the inner wall of the retaining member, the vibration damping member having elasticity for securing the vibration damping member to the retaining member, the vibration damping member being substantially sealed by the retaining member, the vibration damping member is retained at the inner wall of the retaining member by only elastic compression, and the vibration damping member is attached to each of the speaker via a vibration damping member attachment section which is attached to the vibration damping member through an opening in the retaining member substantially sealing the vibration damping member.

2. The speaker retaining mechanism according to claim 1, further comprising a sealing section for sealing the opening.

3. The speaker retaining mechanism according to claim 1, wherein the retaining member has a plurality of protrusions protruding from the inner wall to an interior side.

4. The speaker retaining mechanism according to claim 1, wherein the speaker has a shape extended in one direction and the vibration damping member is attached to both the ends in the extended direction.

5. The speaker retaining mechanism according to claim 1, wherein the vibration damping member is attached to the vibration damping member attachment section by inserting an end of the vibration damping member attachment section into the vibration damping member.

6. The speaker retaining mechanism according to claim 1, wherein the vibration damping member is formed of material having hardness defined in JIS standard (JIS-K6253) not exceeding 10 degrees.

7. The speaker retaining mechanism according to claim 1, wherein the vibration damping member has a cylindrical section, and the vibration damping member is attachable to the retaining member by rotating the vibration damping member in the direction circumferential to the retaining member.

8. A television receiver, comprising:

a cabinet;

a speaker, and a speaker retaining mechanism for retaining the speaker at a predetermined position of the cabinet, the speaker retaining mechanism comprising:

a retaining member that is fixed to the cabinet and that has a hollow tubular space surrounded by an inner wall, and a vibration damping member attached to both ends of the speaker, wherein the vibration damping member is arranged in the hollow tubular space of the retaining member so that the vibration damping member contacts elastically with the inner wall of the retaining member, the vibration damping member having elasticity for securing the vibration damping member to the retaining member, the vibration damping member being substantially sealed by the retaining member, the vibration damping member is retained at the inner wall of the retaining member by only elastic compression, and the vibration damping member is attached to each end of the speaker via a vibration damping member the attachment section which is attached to the vibration damping member through an opening in the retaining member substantially sealing the vibration damping member.

9. The television receiver according to claim 8, further comprising;

a back cover for covering the cabinet, wherein the opening in the retaining member into which the vibration damping member is inserted is formed in a direction of the back cover, the back cover having a sealing section for sealing the opening, and the vibration damping member is arranged such that the vibration damping member contacts elastically with the inner wall of the retaining member and the sealing section.

10. A speaker retaining mechanism for retaining a speaker at a predetermined position of a cabinet, comprising:

a retaining member that is fixed to the cabinet and that has a hollow tubular space surrounded by an inner wall, and a vibration damping member attached to both ends of the speaker, wherein the vibration damping member is arranged in the hollow tubular space of the retaining member so that the vibration damping member contacts elastically with the inner wall of the retaining member, the vibration damping member having elasticity for securing the vibration damping member to the retaining member by only elastic compression, the vibration damping member being substantially sealed by the retaining member, a periphery of the vibration damping member is surrounded by the retaining member, and the vibration damping member is attached to each end of the speaker via a vibration damping member attachment section which is attached to the vibration damping member through an opening in the retaining member substantially sealing the vibration damping member.

11. The speaker retaining mechanism according to claim 10, wherein the retaining member has a plurality of protrusions protruding from the inner wall to an interior side.

12. The speaker retaining mechanism according to claim 10, wherein the vibration damping member has a cylindrical section.

13. The speaker retaining mechanism according to claim 11, wherein the vibration damping member has a cylindrical section.

* * * * *